United States Patent [19]

Krummenacher

[11] 3,939,825

[45] Feb. 24, 1976

[54] APPARATUS FOR PEDICURE

[76] Inventor: Leo Krummenacher, Luzernerstrasse 36, 6030 Ebikon, Switzerland

[22] Filed: Jan. 29, 1975

[21] Appl. No.: 545,106

[30] Foreign Application Priority Data

Jan. 29, 1974 Switzerland ..... 1163

[52] U.S. Cl. ..... 128/52; 128/66; 128/25 B

[51] Int. Cl.[2] ..... A61H 7/00; A61H 9/00

[58] Field of Search..... 128/25 B, 66, 65, 62, 260, 128/51, 52; 4/158

[56] References Cited

UNITED STATES PATENTS

| | | | |
|---|---|---|---|
| 1,712,521 | 5/1929 | Rothchild et al. | 128/65 X |
| 2,837,334 | 9/1974 | Johnson | 128/25 B |
| 3,359,572 | 12/1967 | Blackwell | 128/25 B |
| 3,612,052 | 10/1971 | Krummenacher | 128/260 |
| 3,810,463 | 5/1974 | Krummenacher | 128/66 |

FOREIGN PATENTS OR APPLICATIONS

| | | | |
|---|---|---|---|
| 6,022 | 1899 | United Kingdom | 4/158 |

*Primary Examiner*—Lawrence W. Trapp
*Attorney, Agent, or Firm*—Hill, Gross, Simpson, Van Santen, Steadman, Chiara & Simpson

[57] ABSTRACT

Apparatus for pedicure comprises an open top treatment chamber receptive of at least one human foot within an upwardly opening generally channel shaped foot-receiving device within the chamber and provided with foot-scrubbing means, a foot rest within the device, and means for effecting relative reciprocation between the device and the foot rest for foot-scrubbing action. Provisions are made for spraying treatment fluid on the foot, alternating with drying air. Recirculation of liquid treating fluid can be effected.

15 Claims, 3 Drawing Figures

APPARATUS FOR PEDICURE

This invention relates to pedicure, and in particular for treatment of human feet including at least washing such as with a medicated solution while providing a scrubbing action, and then at least optionally followed by drying.

Two earlier examples of pedicure apparatus are disclosed in my U.S. Pat. No. 3,612,052, issued Oct. 12, 1971 and U.S. Pat. No. 3,810,463, issued May 14, 1974. In the first of those patents, a basin-shaped scrubbing brush arrangement is disclosed rotatably driven about its central axis. In the second patent, a generally basin-shaped arrangement is disclosed wherein the bottom and side wall structures provided with scrubbing brush means are relatively rotatable and thereby attain a reduction in the turque or torsional moment acting upon the foot being treated. Each of the patented arrangements provides for application of treating liquid to the feet, in the first patent the liquid being sprayed from one edge of the basin, and in the second patent an improved arrangement providing for a treating shower or spray from the center of the basin. In one arrangement according to the second patent, the basin wall structure is rotatable and the bottom is stationary and provided with a plurality of rotatable generally disk-shaped brushes and this arrangement does reduce to a considerable extent torsional moments acting upon the treated feet.

However efficiently the described prior arrangements have been, these apparati have various complications as to structure and driving means. Because of the generally braking action of the feet under treatment standing on or against the rotating parts, fairly powerful driving motors must be used. In addition, to achieve contact of the brush elements with all the surfaces of the foot is a rather complex designing problem. Therefore the prior devices cannot be provided in as compact a form in production as would be desirable. Production of the scrubbing or brush areas or devices of the prior arrangements cannot be accomplished as economically as desirable, and removal and replacement and cleaning presents some problem.

It is therefore an important object of the present invention to overcome the disadvantages, deficiencies, inefficiencies, shortcomings and problems in prior devices of the class of pedicure devices indicated, and to provide new and improved apparatus for pedicure as will become more apparent herein.

According to the present invention, there is provided an improved apparatus for pedicure having at least one and preferably two foot-receiving scrubbing devices within an open top treatment chamber and which devices are of upwardly opening generally channel shape to receive individual feet to be treated and provided with foot scrubbing means, there being a foot rest within each of the devices, and means for effecting relative reciprocation of the devices and the foot rest to provide a foot scrubbing action of the scrubbing means, i.e., brushes, with respect to the foot on the foot rest within each of the devices.

According to other features of the invention means are provided for applying treating fluid from one end of the devices and drying air from the opposite end of the devices.

Other objects, features and advantages of the invention will be readily apparent from the following description of the preferred embodiment thereof, taken in conjunction with the accompanying drawings although variations and modifications may be effected without departing from the spirit and scope of the novel concepts embodied in the disclosure, and in which.

Figure 3:
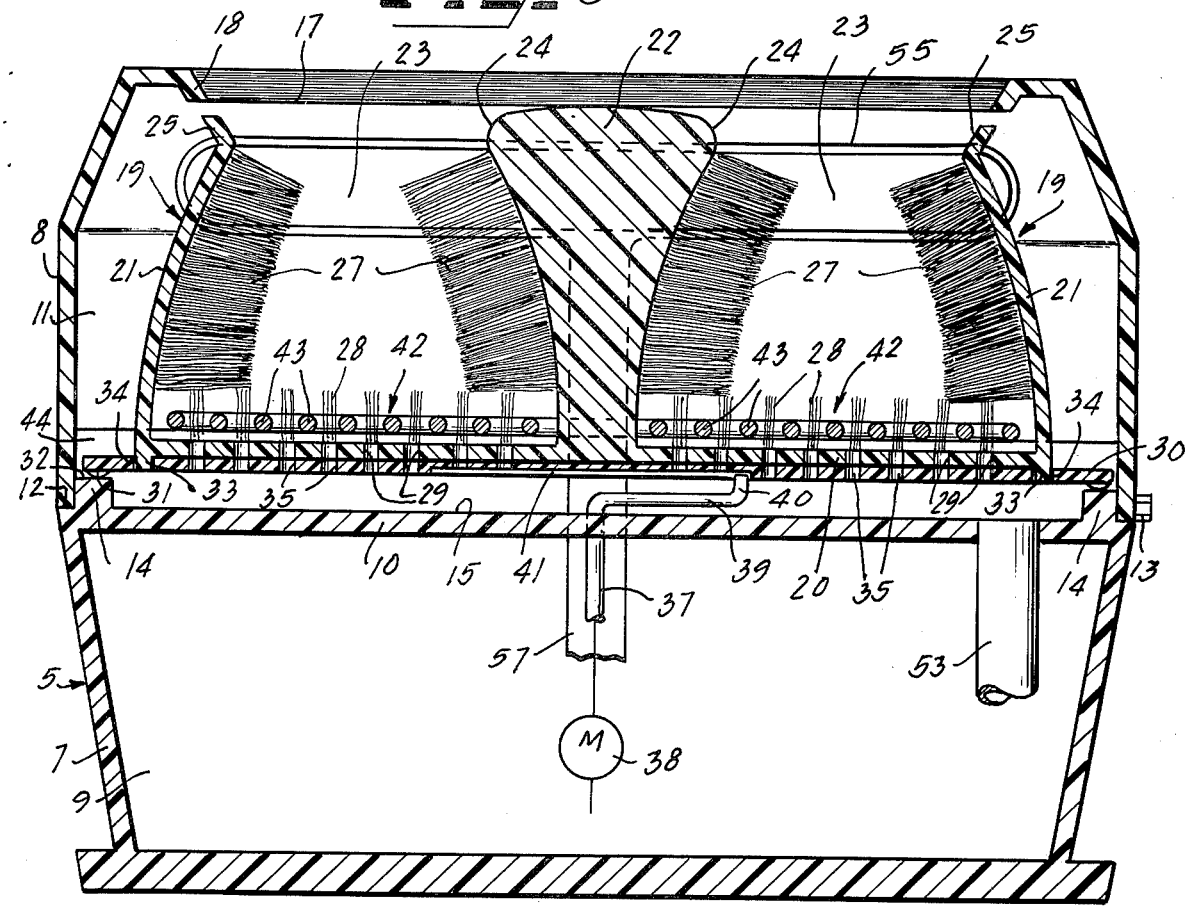
FIG. 3 is a transverse vertical sectional view taken substantially along the line III—III of FIG. 2.
Figure 1:
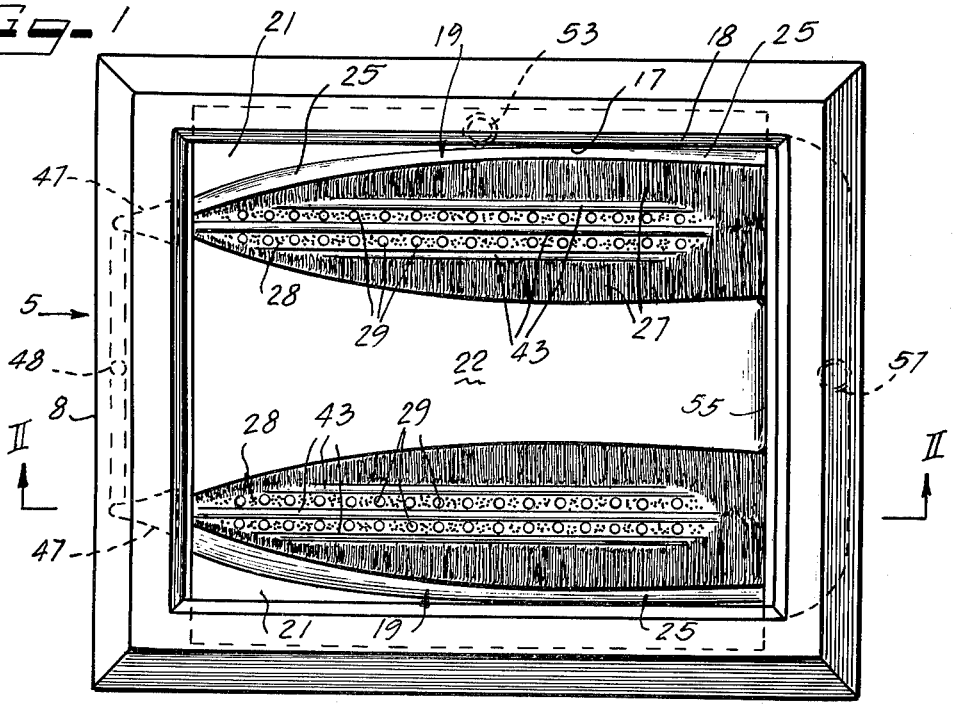
FIG. 1 is a small scale plan view of apparatus embodying the invention.

Apparatus embodying the invention, as exemplified in the drawings, comprises a neat, compact unit within a housing 5 of any preferred shape in plan, such as rectangular, round, oval, polygonal or other desirable geometric form. In a preferred arrangement, the housing 5 is in a two part construction comprising a lower chamber and stand section 7, and an upper treatment chamber section 8. Preferably the lower section 7 provides therein a housing chamber or compartment 9 for various operating mechanisms and control devices for the unit and separated by a horizontal leakproof upper sealing wall or partition 10 from a treatment chamber 11 within the upper section 8. Both of the housing sections 7 and 8 are adapted to be made from suitable rigid, chemically inert, synthetic plastic material. For convenience in assembly and separation, the upper section 8 is mounted on the lower section 7 in a separable leakproof manner as by having a lower vertical edge portion seated in frictional snug relation within a generally rabbet groove seat 12 provided in the upper rim portion of the section 7. To assure position retention of the top section 8, one or more retaining screws 13 may secure the lower margin of the section 8 to a rib 14 providing the upper rim of the section 7 and serving as a curb about a sump area 15 on top of the partition 10. At its upper end, the upper section 8 is open topped providing an access opening 17 into the chamber 11 and defined by a down turned lip flange 18 about the opening.

One or both of a person's feet to be treated are adapted to be received through the opening 17 into the chamber 11. Treating means within the chamber 11 comprise at least one, and preferably two upwardly opening, generally channel-shaped foot-receiving devices 19. One of the devices 19 is adapted to receive the left foot, and the other of the devices 19 is adapted to receive the right foot. In a preferred form, the devices 19 are molded integrally in one piece from a self-sustaining but elastic synthetic plastic material comprising a base wall 20 for each of the devices, an outer upstanding longitudinally extending side wall 21 and an upstanding central common longitudinally extending dividing wall 22, the opposite ends of respective foot-receiving cavities 23 within the devices being open. As best seen in FIG. 3 the side walls 21 are turned progressively upwardly into slightly overhanging relation to the cavities 23, and the dividing wall 22 has its cavity-facing wall surfaces similarly and complementary arched. In width across the bottom of each of the cavities 23, the devices are as large as the widest foot that it may be expected to accommodate therein. In length, each of the devices is slightly shorter than the longest foot that may be expected to be accommodated within the cavities 23. While the center or divider wall partition 22 is preferably of substantial mass and thus stiffness and with a wide handle thickness upper portion so as to facilitate grasping the same for manipulation into and out of the treating chamber 11, the side walls 21 are preferably elastically deformable to facilitate entry and removal of a foot through the top opening gap provided thereby relative to the associated cavity 23. A smoothly rounded side edge 24 is provided along each side of the crown handle portion of the divider 22, and each of the side walls 21 is provided with a generally outwardly flaring upper edge cam lip 25 with which the inwardly sloping rim 18 of the upper section 8 may be generally aligned, as best viewed in FIG. 3. For best results, the plan geometry of the devices 19 has the rear or heel portion within the cavity 23 slightly narrower than the forward portion, generally conformable to a human foot. In addition, the rear or heel end portion of each of the devices 19 preferably has the side walls relatively open at the top, generally as seen in FIG. 3, while the forward toe and instep receiving areas of the devices are arched inwardly to a greater extent so as to partially cover over the toe and instep portions of the foot received within the cavity 23.

Scrubbing means are provided within each of the cavities 23 therein, so constructed and arranged that efficient scrubbing of any size foot to be accommodated within the chamber will be effected in operation of the apparatus. For this purpose, the surfaces defining the opposite sides of each of the chambers 23 are provided with inwardly projecting flexible elements 27 of any preferred form such as brush bristles or narrow fins and suitable length to project inwardly sufficiently to assure thorough brushing, scrubbing contact with feet from the largest size to be accommodated to the smallest size to be accommodated. Preferably the entire areas of the device surfaces which will confront surfaces of the foot to be treated within each of the cavities 23 is covered with the flexible elements 27. At the maximum turned in portions of the cavity wall surfaces, the flexible elements 27 project generally downwardly as well as inwardly so as to make efficient scrubbing contact with the toes and instep of the foot.

Along the bottom wall 20 of each of the devices 19 upstanding flexible bristle or narrow vane flexible elements 28 are provided in a suitable overall pattern consistent with a pattern of drainage holes wherein extending through the base walls 20.

Means are provided for effecting a reciprocating scrubbing action of the devices 19. For this purpose the one-piece unit providing the devices 19 is separably mounted on a carriage comprising a rigid plate 30 which may be constructed of any suitable material such as a chemically inert synthetic plastic material, stainless steel, or the like and which is desirably slightly wider at each side than the base structure 20 of the devices 19 so that anti-friction means such as bearing rollers or balls 31 can support the carriage to ride reciprocably along upwardly facing track surfaces 32 provided by the curb rib 14 along the sides of the chamber 11. Releasable assembly of the foot cavity scrubbing unit which the carriage 30 is facilitated by the provision of bosses 33 projecting from the bottom of the base structure 20 and received in respective sockets 34 provided in the carriage plate. Drainage holes 35 in the carriage plate 30 are aligned with the drainage holes 29 to communicate with the sump 15.

The length of the foot-receiving and scrubbing cavity unit provided by the devices 19 and the corresponding lengths of the carriage 30 is suficiently less than the length of the chamber 11 so that a substantial range of reciprocating foot scrubbing movement can be imparted to the carriage and the supported scrubbing devices. Means for reciprocating the carriage comprise in a simple and efficient arrangement an eccentric or crank comprising a shaft 37 extending through and journaled in the partition 10 and driven by a suitable motor 38 mounted within the compartment 9 to rotate a crank arm 39 in the space below the carriage 30 to actuate an upwardly extending stud 40 in a transversely extending crank follower groove 41 provided in the underside of the carriage 30. Thereby, as the crank is rotated, the carriage 30 and the scrubbing unit transported thereby will be reciprocated longitudinally within the chamber 11. The length of the reciprocation stroke depends on the length of the crank arm 39 and may range from 10 to 50 mm, or longer.

In order to relieve the feet to be treated from strain and to relieve scrubbing devices 19, and thereby the carriage 30 and likewise the motor 38 from foot imposed load, foot rest means 42 are provided within each of the devices 19 wherein a simple and convenient construction, the foot rest means comprise respective grids or gratings made up of suitable small bars or rods 43 extending longitudinally through each of the cavities 23 in narrowly spaced relation above the floor panel or wall 20 and resting at opposite ends on suitable shoulders 44 (FIG. 2) provided for this purpose. Uniform spacing of the rods 43 may be effected in any suitable manner such as by means of transversely extending cross or tie rods 35 adjacent to the opposite ends of the rods 43, and if desired at other intervals along the rods. In a preferred arrangement, spacing of the foot rest rods 43 is such as to alternate with the transverse spacing of rows of the drain holes 29. Further, the spacing between the rods is ample to permit projection upwardly in the spaces between the foot rest rods of the upwardly extending resiliently flexible scrubbing elements 28 so that these elements can make efficient scrubbing contact with the bottom of a foot resting on the foot rest. It will thus be apparent, that the scrubbing elements 27 are well as the scrubbing elements 28 can efficiently scrub the foot resting stationarily upon the foot rest 42, and with minimum power expenditure in effecting reciprocations of the scrubbing devices. Therefore, the motor 38 may be an inexpensive relatively low power unit, and the power transmission structure including the crank devices may be of minimal, economical construction.

Means are provided for supplying treating liquid to the footreceiving cavities 23, and preferably into the front or toe end portions thereof. For this purpose a double shower head arrangement is desirable comprising a shower head 37 aligned with each of the cavities 23 and supported by an elevation within the chamber 11 adjacent to the front end of the associated cavity 23 as by means of suitable supply pipe structure 48 extending upwardly from within compartment 9 and receiving the treating liquid under suitable pressure from a pump 49 within the compartment 9, delivering the liquid preferably through a heater 50. Since the footreceiving cavities 23 are at least partially open at the top and at the end, the liquid spray from the shower heads 47 will be impinged with excellent results upon the feet being treated. In addition, or alternatively, the shower heads 47 may be located to direct spray into the rear or heel ends of the cavities 23. Treating liquid may be in the form of water either plain or medicated derived from a suitable source through a supply duct 51 communicating through a multi-stage and suitably controlled valve 52 with the pump 49. Where it is desired to recirculate medicated solution, a drain 53 from the sump 15 may be selectively connected through the valve 52 with the pump 49 alternatively to the fresh liquid supply from the supply duct 51. For waste drainage of fluid from the sump 15 through the drain 53, the valve 52 is operated to provide a connection with a waste drain duct 54.

After a suitable interval of liquid and scrubbing treatment, the shower heads 47 are discontinued, that is disconnected or at least the pump 49 stopped, and the treated feet may be removed from the cavities 23. In a preferred arrangement, however, drying air is supplied to the cavities 23 while the feet are still in the cavities, and while the scrubbing devices 19 are still reciprocated. For this purpose a drying air nozzle 55 of horizontally elongated form is desirably mounted at either end of the cavities 23, but preferably at the heel or rear ends thereof with supply pipe means 57, or the like, supporting the nozzle 55 across the upper portions of the end openings into the cavities 23. Air of suitable volume and velocity is provided by a blower 58 mounted within the compartment 9, with a suitable heater 59 in the line for assuring a comfortable and fast drying temperature for the drying air.

Figure 2:
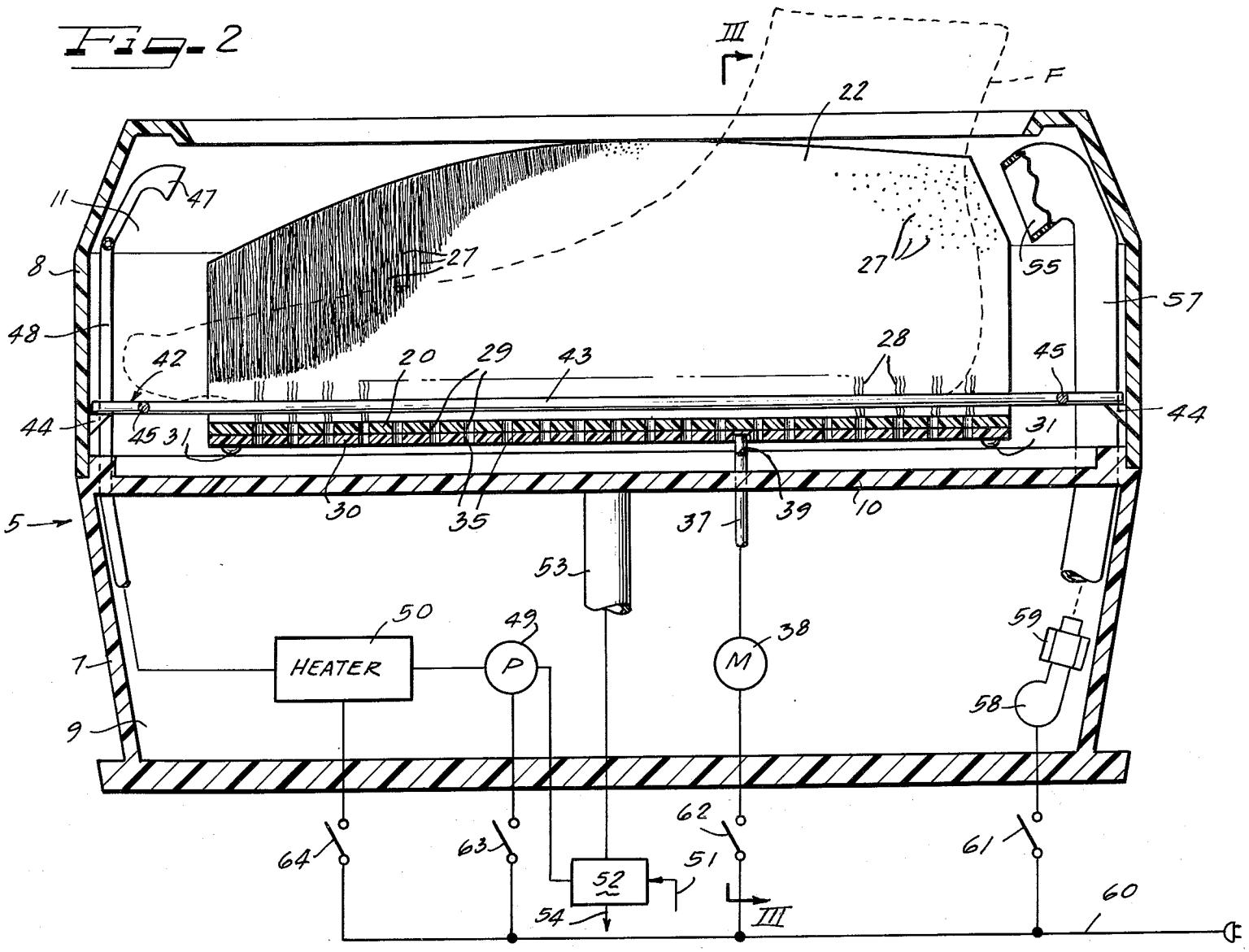
FIG. 2 is a longitudinal sectional view of the device taken substantially along the line II—II of FIG. 1.

Suitable means for controlling the several operating components of the apparatus are provided, and which may be either automatic or manual controls, exemplified by the electrical control system schematically depicted in FIG. 2 and comprising an electrical energy source lead such as a plug-in extension 60 connected through a switch 61 with the blower 58 and the heater 59, connected through a switch 62 with the motor 38, connected through a switch 63 with the pump 49 and desirably connected through a switch 64 with the liquid heater 50. If preferred, a control system for the various switches and the valve 52 may be of the automatic cyclical type as exemplified in my prior Patent 3,810,463.

In a typical operating cycle, the user will place one or both feet into the treating chamber 11, with each foot in the respective cavity 23 within the respective scrubbing device 19, substantially as indicated by the phantom outline F in FIG. 2, with the feet resting upon the respective rests 42. By reason of the resilient flexibility of the side walls 21 of the devices 19 and the resilient flexibility of the scrubbing elements 27 and 28, the foot can be easily moved into position and subsequently easily withdrawn. Because the devices 19 are reciprocated in operation, full scrubbing contact can be effected even though the devices 19 are slightly shorter than the largest foot received therein, thereby maintaining the overall length dimensions of the housing desirably small, thus contributing to compactness of the apparatus unit. Treating solution is supplied onto the feet within the cavities 23, and the devices 19 are reciprocated, whereby the feet are thoroughly scrubbed and massaged by action of the scrubbing, i.e. brushing, elements 27 and 28, the action being especially effective in the area of the toes and insteps of the feet. After a suitable interval of liquid treatment, the liquid supplied may be discontinued, For some purposes, it may be desirable to operate the 52 to close the drain 53 and permit the treating liquid to accumulate in a bath of some depth within the treating chamber 11 while the apparatus continues to operate in that the scrubbing devices 19 continue to reciprocate. If desired an automatic shut-off may be provided to avoid overflow. After the desired liquid treatment has been concluded, drying air may be supplied through the nozzle 55, while the scrubbing devices 19 continue reciprocating whereby the flexible elements 27 and 28 will continue massaging the feet and excellerating drying.

It will be understood that variations and modifications may be effected without departing from the spirit and scope of the novel concepts of this invention.

I claim as my invention:

1. Apparatus for pedicure, comprising:

means defining an open top treatment chamber receptive of at least one human foot;

at least one foot-receiving scrubbing device within said chamber provided with an upwardly opening generally channelshaped cavity having foot scrubbing means therein affixed to the device;

foot rest means within said cavity; and means for effecting relative reciprocation of the device and the foot rest means for foot scrubbing action between the scrubbing means with respect to a foot located on the foot rest means within the cavity.

2. Apparatus according to claim 1, comprising a pair of the scrubbing devices in side-by-side unitary relation, each of which has foot rest means therein, and said means for effecting relative reciprocation reciprocates both of said devices in unison.

3. Apparatus according to claim 1, wherein said scrubbing device is open at respectively opposite ends and is generally conformed in plan to human foot shape, having inside dimensions adequate to receive the largest foot size freely, and said foot scrubbing means comprising elongated resiliently flexible scrubbing elements projecting from wall surfaces of the device within said cavity.

4. Apparatus according to claim 1, wherein said foot rest means comprises an elongated member extending lengthwise of said cavity and projecting beyond opposite end openings from the cavity, means supporting opposite ends of the foot rest in stationary relation to said chamber defining means, said scrubbing means comprising elongated flexible elements projecting upwardly within said cavity and extending through said openings in the foot rest.

5. Apparatus according to claim 1, wherein said device has a resiliently flexible wall provided with said scrubbing means in the form of elongated resiliently flexible bristle-like elements.

6. Apparatus according to claim 1, wherein said device comprises a molded plastic element, a carriage reciprocably mounted in said chamber, and means separably connecting said device to said carriage.

7. Apparatus according to claim 6, wherein said means for effecting relative reciprocation comprise a crank drivingly coupled with said carriage, and a motor for driving said crank.

8. Apparatus according to claim 6, including means for spraying treating liquid into said cavity, and means for draining the liquid through said carriage and from said treatment chamber.

9. Apparatus according to claim 8, including means for recirculating through said spraying means the liquid drained from said chamber.

10. Apparatus according to claim 1, including means for delivering treating liquid to said cavity, and means for delivering drying air to said cavity.

11. Apparatus according to claim 1, comprising a pair of said foot-receiving scrubbing devices in side-by-side unitary relation, a common wall between said devices, said common wall providing a handle for manipulating the devices.

12. Apparatus according to claim 1, wherein said device has side walls which arch in convergent relation toward one another, the opposite ends of the cavity of the device being open, and said scrubbing means comprising resiliently flexible bristle-like elements projecting inwardly from the side walls and from the bottom of said cavity.

13. A method of pedicure, comprising:

placing at least one foot into an upwardly opening generally channel-shaped cavity within a footreceiving scrubbing device in an open top treatment chamber;

placing the foot on a foot rest within the cavity; and effecting relative reciprocation of the device and the foot rest and thereby applying scrubbing action to the foot by scrubbing means affixed to the device.

14. A method according to claim 13, comprising applying treating liquid to the foot within said cavity.

15. A method according to claim 13, comprising alternately applying treating liquid and drying air to the foot within the cavity while continuing relative reciprocation of the device and the foot rest.

* * * * *